US006817694B1

(12) United States Patent
Kawasaki et al.

(10) Patent No.: US 6,817,694 B1
(45) Date of Patent: Nov. 16, 2004

(54) INK JET SYSTEM IMAGE FORMING DEVICE

(75) Inventors: Takahiko Kawasaki, Tokyo (JP); Hiroyuki Kunii, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/030,903

(22) PCT Filed: Jul. 12, 2000

(86) PCT No.: PCT/JP00/04642

§ 371 (c)(1),
(2), (4) Date: May 2, 2002

(87) PCT Pub. No.: WO01/03936

PCT Pub. Date: Jan. 18, 2001

(30) Foreign Application Priority Data

Jul. 12, 1999 (JP) ..... 11-197863

(51) Int. Cl.[7] ..... B41J 2/165

(52) U.S. Cl. ..... 347/23; 347/30; 347/33; 347/35; 347/65

(58) Field of Search ..... 347/44, 48, 23, 347/26, 92, 35, 30, 33, 22, 68, 74, 75, 65

(56) References Cited

U.S. PATENT DOCUMENTS

| | | | | | |
|---|---|---|---|---|---|
| 5,479,196 | A | | 12/1995 | Inada | |
| 6,033,051 | A | * | 3/2000 | Kaneko | 347/23 |
| 6,199,972 | B1 | * | 3/2001 | Ishinaga et al. | 347/65 |
| 6,325,492 | B1 | * | 12/2001 | Koitabashi et al. | 347/57 |
| 6,488,354 | B2 | * | 12/2002 | Hosono | 347/23 |

FOREIGN PATENT DOCUMENTS

| | | | |
|---|---|---|---|
| EP | 326428 | | 8/1989 |
| JP | 402011331 | A * | 1/1990 |
| JP | 2-78567 | | 3/1990 |
| JP | 3-246055 | | 11/1991 |
| JP | 04221644 | A * | 8/1992 |

* cited by examiner

*Primary Examiner*—Stephen D. Meier
*Assistant Examiner*—Ly T Tran
(74) *Attorney, Agent, or Firm*—Dellett & Walters

(57) ABSTRACT

An image-forming heater element 52 and a recovery ejection heater element 54 are driven to generate heat at the timing in which a bubble may formed in the nozzle owing to temperature difference between the inside of a printing head 22 and the environment. Thereby, a large quantity of ink is ejected at a time. The ejection of a large quantity of the ink removes a bubble or a foreign matter from the nozzle, cleaning the nozzle in a short time.

15 Claims, 9 Drawing Sheets

INK JET SYSTEM IMAGE FORMING DEVICE

TECHNICAL FIELD

The present invention relates to an ink-jet type image-forming apparatus (hereinafter referred to as an "inkjet imaging apparatus") which forms an image by ejecting an ink through a nozzle of a printing head onto a recording medium with the printing head moved in reciprocation in a prescribed main scanning direction.

BACKGROUND TECHNIQUE

Ink-jet imaging apparatuses for printing by ejecting ink onto a recording medium are known as a kind of output apparatus of computers and work stations. The ink-jet imaging apparatuses are provided, for example, with a printing head which has plural ink ejection nozzles, a carriage which carries the printing head and is moved in reciprocation in a prescribed main scanning direction, and a delivery device which delivers a recording paper sheet in the direction perpendicular to the main scanning direction.

In formation of an image on a recording paper sheet, the delivery of the recording sheet is temporarily stopped, and ink is ejected through the ink ejection nozzles with the reciprocating movement of the carriage in the main scanning direction to form (to print) one printing band portion of an image on the area of the recording sheet placed on an image formation zone. Then the recording paper sheet is delivered by a distance of one printing band breadth and stopped, and again another printing band portion of an image is formed on the newly delivered area of the recording sheet on the image formation zone. By repeating the operation, an entire image is formed on the recording paper sheet.

Generally, the aforementioned plural nozzles are formed on a plate made of glass, silicon or a like material. In the vicinity of the respective nozzles, a heat-generating element (heat-generating element for image formation) is provided. An aluminum base plate backs the silicon plate for strengthening the silicon plate having the nozzles formed thereon.

In an imaging apparatus for forming an image with an ink like the aforementioned inkjet imaging apparatus, the image formed (printed) continuously can cause deterioration of image quality owing to change of the ink ejection state. The change of the ink ejection state may be caused by bubbling of the ink in the nozzle or invasion of a foreign matter (such as paper dust) into the ink.

For removal of the bubbles and the foreign matter from the nozzles, an ejection recovery system is employed which sucks the bubble and the foreign matter forcibly together with the ink to recover the initial normal state of the ink ejection (a state of no bubble and no foreign mater). This ejection recovery system is employed on detection of abnormal ink ejection or at prescribed time intervals during printing.

The ejection recovery system conducts cleaning by covering the opening of the nozzle formed on the printing head with a rubber cap, applying a negative pressure from the outside to suck the ink from the nozzle. Thereby the initial normal state of ink ejection through the nozzle is recovered.

Inside the printing head, the temperature is controlled to control the quantity of the ink ejected through the nozzle in one ink ejection. Thereby, a constant quantity of the ink is ejected from the printing head independently of the temperature outside the printing head. However, the ink ejection may become irregular or fail by formation and accumulation of a bubble in the nozzle owing to temperature difference between the inside and the outside of the printing head. The aforementioned ejection recovery system is effective to solve such a problem.

However, such an ejection recovery system takes long time for the recovery operation, since the system covers the nozzle outlet with a cap and sucks the ink from the nozzle by application of a negative pressure. Therefore, the recovery operation in each time of ejection failure will decrease the number of printed sheets for a unit time (the throughput being lowered).

In usual printing, the printing head is driven to scan immediately after the delivery of the recording paper sheet by a breadth of one printing band portion. Thereby, the time of the printing is kept constant, and the time interval of joining the front end of the printing region to the rear end of the printed region (joint between the printing bands) is constant. However, when the ejection recovery is conducted during the printing with the ejection recovery system, the time interval of the ink overlapping becomes larger at the adjacent printing band joint portion to change the time before the overlapping of the ink at the band joint portion. In other words, the ejection recovery by the ejection recovery system will lengthen the time of the drying of the ink having deposited at the preceding scanning on the recording paper sheet. This may cause change of the color tone at the ink overlap at the band joint, causing irregularity of color.

DISCLOSURE OF THE INVENTION

The present invention intends to provide an inkjet imaging apparatus which is capable of removing a bubble or a foreign matter from an ink ejection nozzle (ejection recovery) in a shorter time under the aforementioned circumstance.

A first embodiment of the inkjet imaging apparatus of the present invention for achieving the above object has a printing head having plural nozzles for ink ejection, and first ink ejection elements formed respectively near each of the nozzles for ejecting the ink from the nozzle; and forms an image by driving the first ink ejection element to eject the ink, wherein the inkjet imaging apparatus comprises:

(1) second ink ejection elements formed respectively upstream against the ink ejection direction before the first ink ejection element for ejecting the ink from the nozzles, and (2) a controller which drives, on prescribed ejection recovery, the first ink ejection elements and the second ink ejection elements simultaneously to eject the ink through the nozzles for ink ejection recovery.

A second embodiment of the ink-jet imaging apparatus of the present invention for achieving the above object has a printing head having plural nozzles for ink ejection, and plural ink ejection elements formed respectively near each of the nozzles for ejecting the ink from the nozzle; and forms an image by driving any of the ink ejection elements to eject the ink in accordance with image information signals, wherein the ink-jet imaging apparatus comprises:

(3) a controller which drives, on prescribed ejection recovery, two or more of the ink ejection elements simultaneously to eject the ink through the nozzle for ink ejection recovery.

(4) The controller may function to change timing of ink ejection of the ink ejection element in correspondence with the shape of the ink liquid face at the outlet of the nozzle.

The controller may be provided with (5) a temperature sensor for detecting the inside temperature of the printing head, and (6) a controller which drives, on prescribed ejection recovery, both of the first ink ejection element and the second ink ejection element simultaneously at prescribed time intervals intermittently in correspondence with the temperature detected by the temperature sensor to eject the ink through the nozzles.

The above ink-jet imaging apparatus may have (7) two or more of the printing heads, and (8) the controller may decide the time interval for each of the printing heads in correspondence with properties of the ink to be ejected from the nozzle of each of the printing heads. The above ink-jet imaging apparatus may have (9) a memory for memorizing preliminarily the prescribed time interval varying in dependence of the inside temperature of the printing head for each of the inside temperature,

(10) the controller may control both of the first ink ejection element and the second ink ejection element to eject the ink at intervals memorized in the memory based on the inside temperature detected by the temperature sensor, and

(11) the controller may decide the number of times of simultaneous driving of the first ink ejection element and the second ink ejection element based on the temperature detected by the temperature sensor.

The above ink-jet imaging apparatus may have

(12) two or more of the printing heads, and

(13) the controller may decide the above-mentioned number of times for each of the printing heads independently in accordance with properties of the ink to be ejected through the nozzles of each of the printing heads,

(14) The above memory may memorize the number of times of simultaneous driving of the first ink ejection element and the second ink ejection element, varying with the inside temperature of the printing head, and

(15) the controller may control both of the first ink ejection element and the second ink ejection element to eject the ink in the number of times and in the time intervals derived from the memory depending on the inside temperature detected by the temperature sensor.

A third embodiment of the inkjet imaging apparatus of the present invention for achieving the above object has a printing head having plural nozzles for ink ejection, and first ink ejection elements formed respectively near each of the nozzles for ejecting the ink from the nozzle; and forms an image by driving the first ink ejection element to eject the ink, wherein the ink-jet imaging apparatus comprises:

(16) second ink ejection elements formed respectively upstream against the ink ejection direction before the first ink ejection element for ejecting the ink from the nozzles, having higher ink-ejection performance than the first ink ejection elements.

The ink-jet imaging apparatus may have

(17) a controller which drives the first ink ejection elements at a prescribed first timing, and drives the second ink ejection elements at a second timing later than the first timing.

The above inkjet imaging apparatus may have

(18) a counter for counting the number of times of driving of the first ink ejection elements, and

(19) the controller may drive the second ink ejection elements when the count of the counter reaches a prescribed number of the times.

The above ink-jet imaging apparatus may have

(20) a temperature sensor for detecting the inside temperature of the printing head,

(21) the controller may change the number of times of driving of the second ink ejection element in accordance with the temperature detected by the temperature sensor, and

(22) the above ink ejection element may be a heater element which generates heat, or a piezo element which causes a piezo electric effect.

BEST MODE FOR CARRYING OUT THE INVENTION

The embodiments of the inkjet imaging apparatus of the present invention are described below by reference to drawings.

Figure 1:
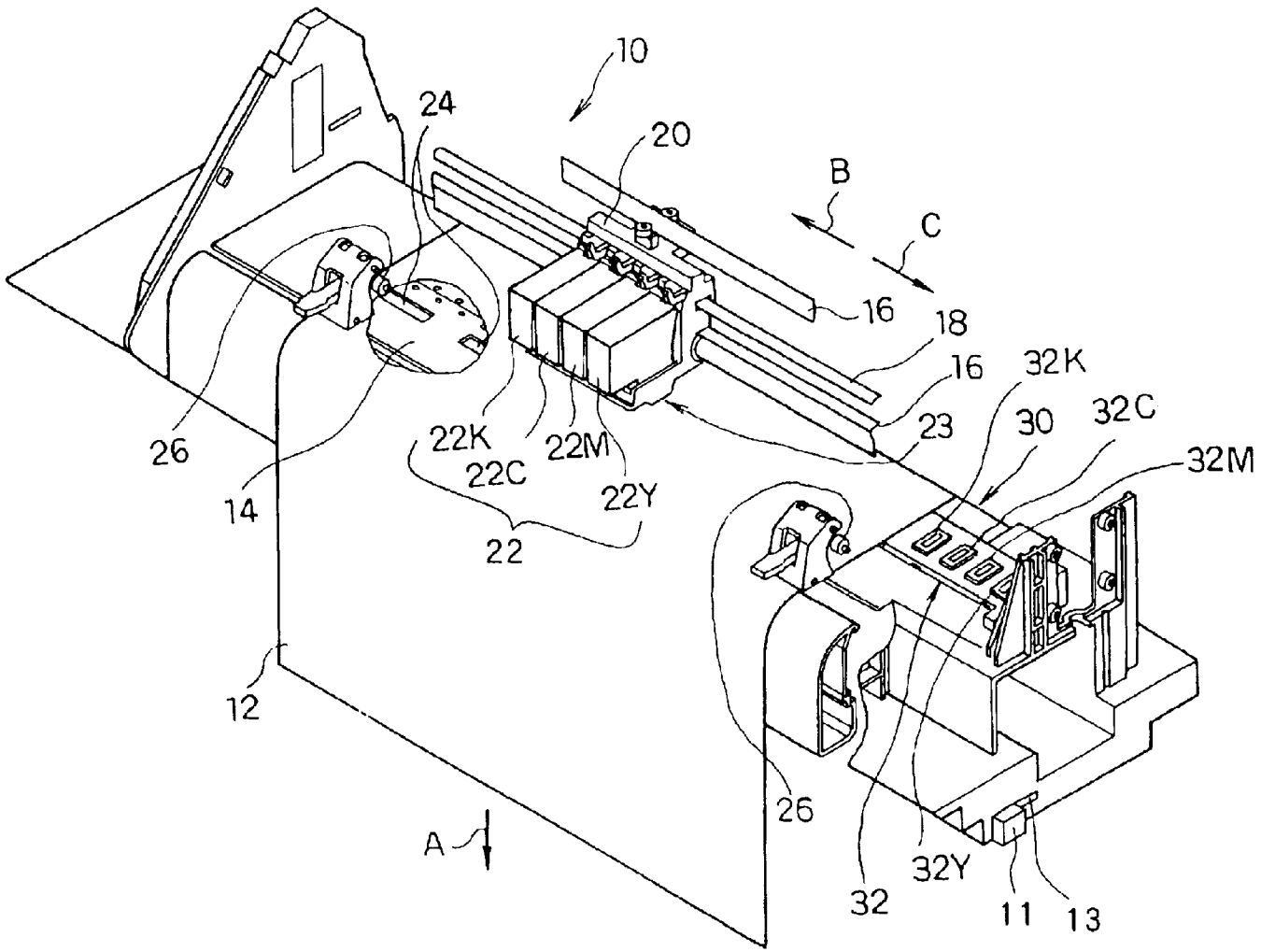
FIG. 1 is a perspective view illustrating an embodiment of the ink-jet imaging apparatus of the present invention.

FIG. 1 is a schematic perspective view of a plotter which is a first embodiment of the ink-jet imaging apparatus of the present invention.

A plotter 10 has a platen 14 onto which a recording paper sheet 12 is delivered in the direction shown by the arrow A. Above the platen 14, two scanning rails (guide rails) 16 are provided in parallel to the platen 14. Onto the scanning rail 16, a carriage 16 is mounted through a slide bearing (not shown in the drawing). This carriage 20 can be driven in reciprocation (capable of scanning) by a motor (not shown in the drawing) and a belt 18 in the directions of arrows B,C (perpendicular to the arrow A direction, the main scanning direction in the present invention).

Figure 2:
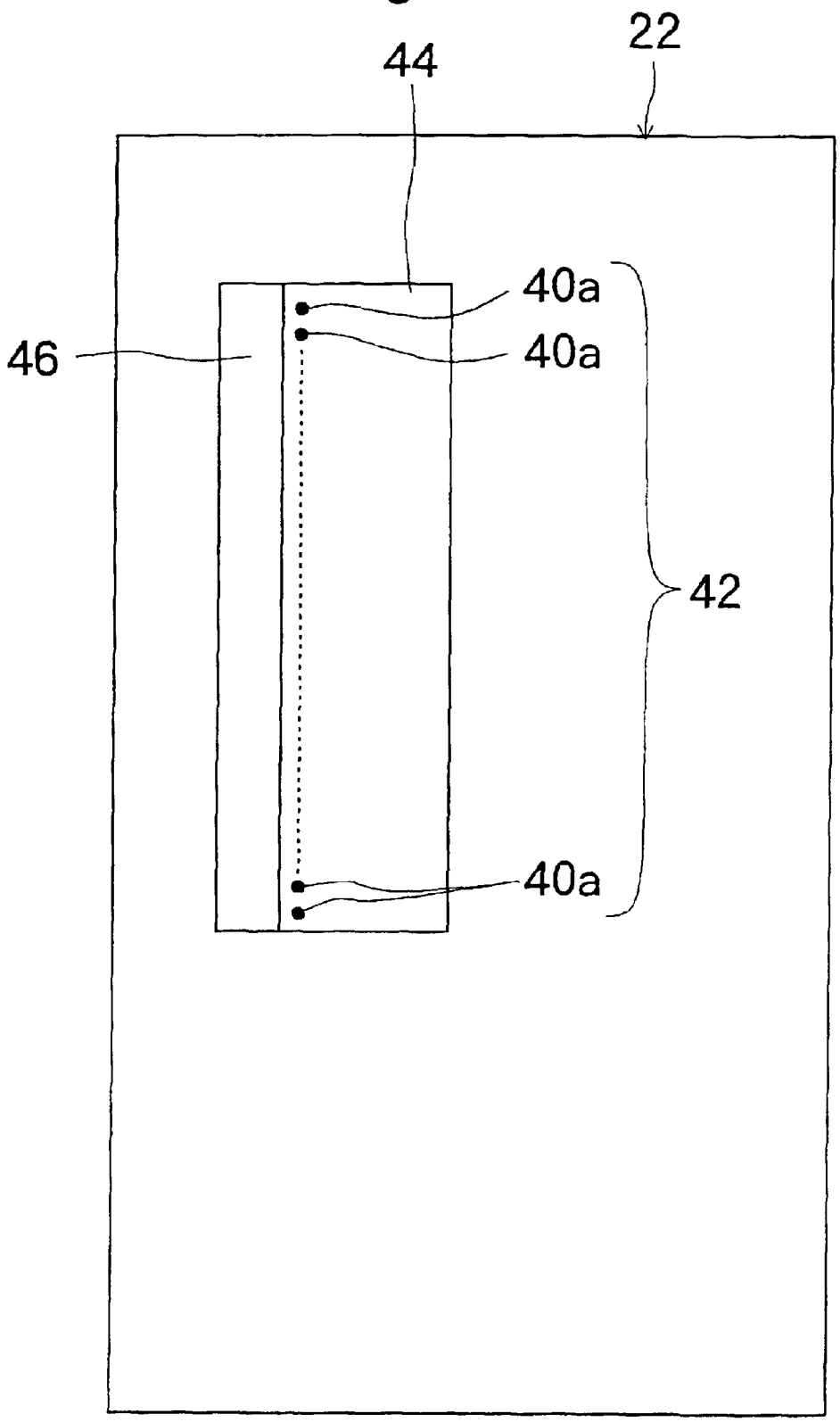
FIG. 2 is a schematic drawing illustrating the bottom face (ink ejection face) of a printing head.

The carriage 20 has four printing heads, 22K (black), 22C (cyan), 22M (magenta), and 22Y (yellow) mounted thereon, each printing head having plural ink ejection outlets (outlets 40*a* of the nozzle 40, see FIG. 2). The ink ejection outlets are placed in front of the image formation zone 23. The ink is ejected from the ink outlets onto a portion of a recording paper sheet 12 placed in an image formation zone 23 to form a portion of an image.

An ink ejection recovery device 30 is placed at a position on one side of the movement range of the carriage 20, outside the image formation zone 23. This ink ejection recovery device 30 sucks the ink forcibly from the nozzle to clean the ink feeding path and the nozzle formed in the printing head 22 and to recover the initial state of ink ejection.

The ejection recovery device 30 has four rubber caps 32K, 32C, 32M, 32Y which cover respectively the nozzle outlets of the printing heads 22K, 22C, 22M, 22Y detachably. To the respective caps 32K, 32C, 32M, 32Y, tubes (not shown in the drawing) are connected, and the other ends of the tubes are connected to a suction pump (not shown in the drawing). The four caps 32K, 32C, 32M, 32Y are fixed onto a cap stand 32. In operation of the ejection recovery as mentioned later, the carriage 20 is moved above the caps 32, and the inks are ejected from the printing heads 22 onto the caps 32.

In image formation on a recording paper sheet 12 like a rolled paper sheet, the recording paper sheet is placed on the platen 14, and is held between delivery rollers 24 having the peripheral faces emerging partly through openings (not shown in the drawing) of platen 14, and pinch rollers 26 which press the ends of the recording paper sheet 12. The recording paper sheet 12 is delivered by rotation of the delivery rollers 24 driven by a delivery motor (not shown in the drawing). The carriage 20 is moved in reciprocation in the directions of the arrows B and C above the recording paper sheet 12. The inks are ejected from the nozzles in accordance with image signals (signals bearing image information) transmitted from the head controller 11 (an example of the controller of the present invention) to the printing heads 22K, 22C, 22M, 22Y to form an image on the portion of the recording paper sheet 12 placed on the image formation zone 23. During the image formation operation, when removal of a bubble or a foreign matter becomes necessary, the recovery ejection is conducted as mentioned later. On completion of the image formation, a cutter (not shown in the drawing) mounted on the carriage 20 is allowed to protrude to a prescribe position and allowed to traverse the carriage 20 to cut the recording paper sheet 12 in a prescribed size.

The structure of the printing head 22 is explained by reference to FIGS. 2–4.

FIG. 2 is a schematic drawing illustrating the bottom face (ink ejection face) of a printing head. FIG. 3 is a schematic plan view of heater elements and the like arranged on an aluminum base plate. FIG. 4 is a cross-sectional view of a nozzle of a printing head.

FIG. 2 shows many outlets 40*a* of the nozzles 40 arrayed in a nozzle line 42 on a bottom face (ink ejection face) of the printing head 22. The nozzles 40 are formed on a silicon base plate 44, and extend in the direction nearly perpendicular to the paper face of FIG. 2. The silicon base plate 44 is backed by an aluminum plate 46 for strengthening the silicon base plate 44.

Figure 3:
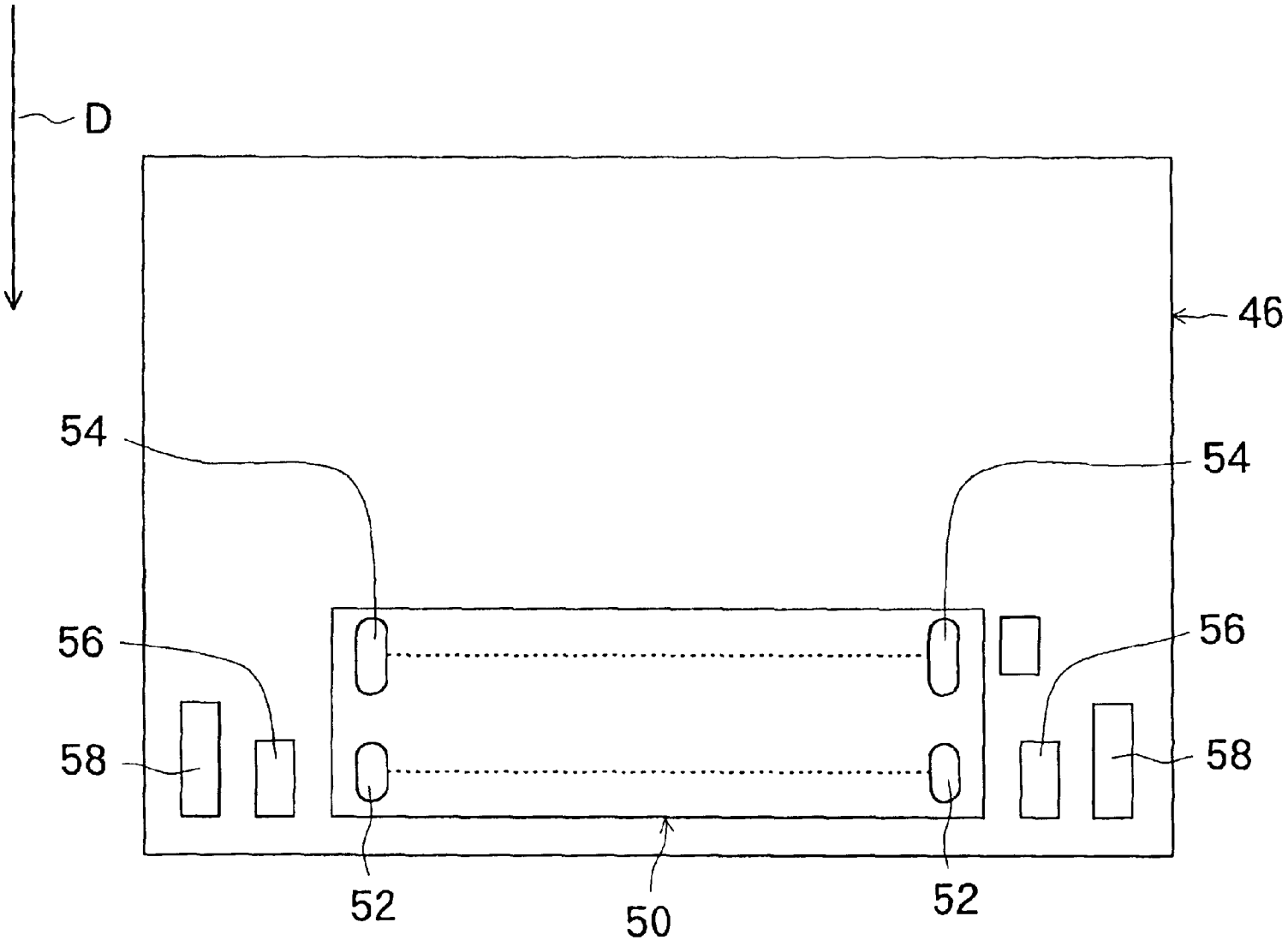
FIG. 3 is a schematic plan view of heater elements arranged on an aluminum base plate.

FIG. 3 shows an ink ejection heater element line 50 formed on a downstream side in the ink ejection direction (arrow D direction) of the ink 41 (FIG. 4) on the surface of the base plate 46 for ink ejection from the nozzles 40. This ink ejection heater element line 50 comprises image-forming heater elements 52 (an example of the first ink ejection elements in the present invention) which generates heat in accordance with image information signals to eject ink 41 to form an image, and ejection-recovering heater elements 54 (an example of the second ink ejection elements in the present invention) which allows ejection of the ink 41 from the nozzles in the time other than image formation.

Figure 4:
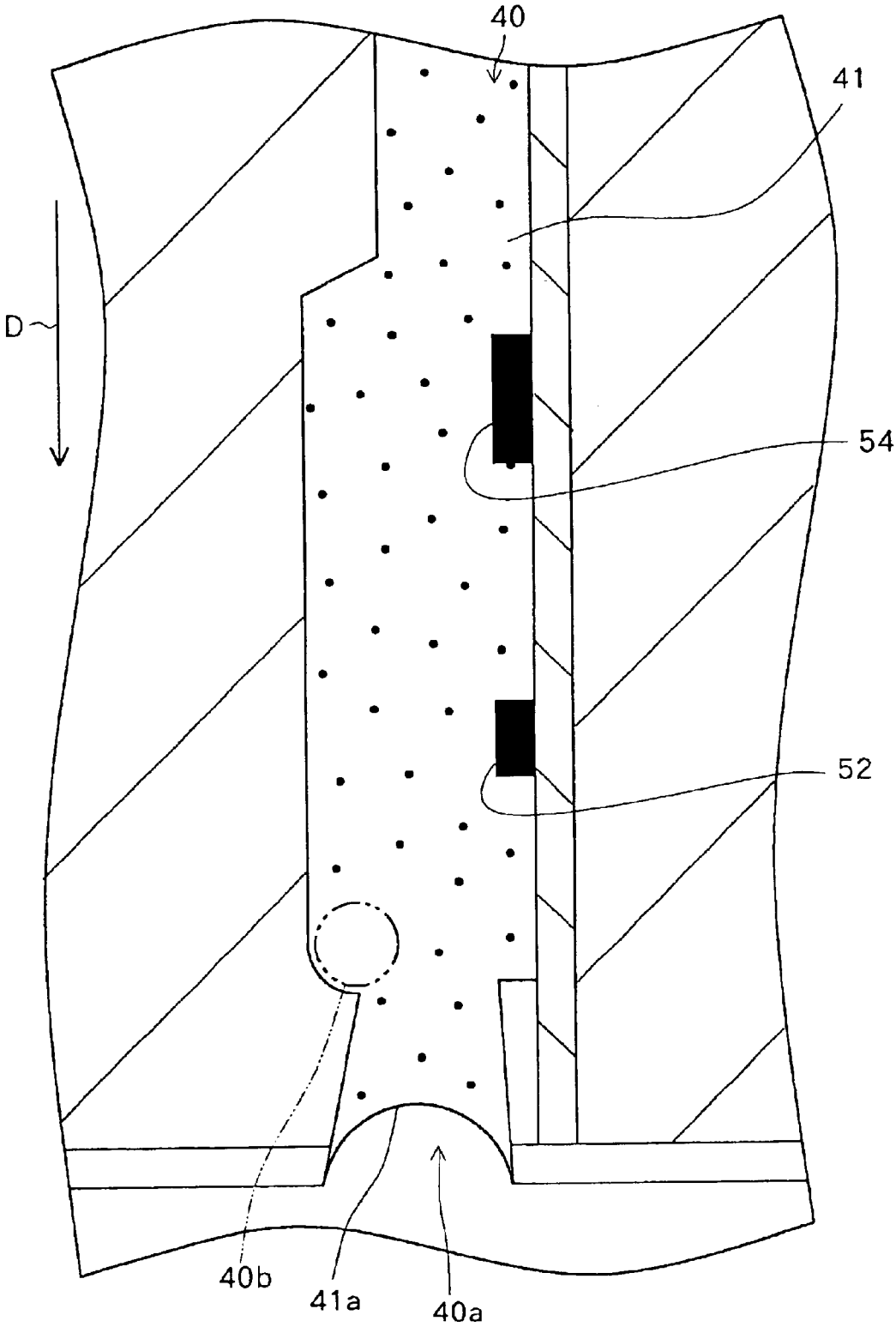
FIG. 4 is a cross-sectional view of a nozzle of a printing head.

The image-forming heater elements 52 and the ejection-recovering heater elements 54 are provided in pairs for the respective nozzle 40 as shown in FIG. 4, the image-forming heater elements 52 being placed downstream in the arrow D direction after the ejection-recovering heater elements 54.

On the face of the base plate 46, on each of the end sides of the ink ejection heater element line 50 (both sides in the direction perpendicular to the arrow D), there are provided a head-inside temperature detecting DI sensor 56 (an example of the temperature sensor in the present invention) for detecting the inside temperature of the printing head 22. Outside the head inside temperature detecting DI sensors 56 on the face of the base plate 46, are provided head temperature-adjusting heater elements 58 for adjusting the inside temperature of the printing head within a prescribed range.

All the image-forming heater elements 52 and all the ejection-recovering heater elements 54 are controlled by a head controller 11 (FIG. 1) to generate heat simultaneously at a prescribed timing. Herein the "prescribed timing" means the timing of bubble formation in the nozzle 40, for example, caused by temperature difference between the inside and outside of the printing head 22. The simultaneous heat generation by the image-forming heater element 52 and the ejection-recovering heater element 54 causes ejection of a larger quantity of the ink 41 from the nozzle 40. Thereby any bubble or any foreign matter is removed by the ink flow. Such ejection of the ink 41 from the nozzle 40 for removal of a bubble or a foreign matter out of the nozzle 40 by simultaneous heat generation of the image-forming heater elements 52 and the ejection recovering heater elements 54 is herein called "recovery ejection". The recovery of ejection can be conducted in a short time by the recovery ejection since it can be conducted simply by simultaneous heat generation of the image-forming heater elements 52 and the ejection-recovering heater elements 54. By this recovery ejection, the bubble and the foreign matter in the nozzle 40 are ejected together with the ink 41, and thereby the bubble, the foreign matter, and dried ink residue are removed from each of the nozzles to recover the normal state of the nozzle 40 (state of no-bubble and no-foreign matter).

Only a short time is necessary for ejecting the ink 41 by simultaneous heat generation of the image-forming heater elements 52 and the ejection-recovering heater elements 54. In contrast, the forcible suction of ink through each of the nozzles 40 by means of a suction pump of the recovery device 30 (FIG. 1) requires a longer time. Thus, the nozzle inside can be brought to the normal state by simultaneous heat generation of the image-forming heater element 52 and the ejection-recovering heater element 54 in a shorter time than that by suction by the recovery device 30.

In normal printing, the printing head is allowed to scan immediately after the delivery of the recording paper sheet by the breadth of one printing band, thereby the printing time being kept constant. Therefore, the time interval between the printing of the rear end of the preceding print region by preceding head scanning and the overlapping of the front end of the printing region of the subsequent printing (joint of the bands) is constant invariably. However, when the ejection recovery is conducted with the recovery device 30 during printing, the next printing head scanning is delayed, changing the time before the overlapping at the printing band joint portion from that of the normal printing. In other words, the recovery operation by means of the recovery device 30 lengthens the drying time of the ink deposited by the preceding scanning onto the recording paper sheet. Thereby, the color tone at the ink overlapping portion at the printing ink bands can be changed from that of the normal printing to cause color irregularity of the formed image. However, in the present invention, the recovery ejection recovers the state inside the nozzle in a shorter time, preventing the above color irregularity.

An example of timing of the simultaneous heat generation of the image-forming heater element 52 and the ejection-recovering heater elements 54 is explained by reference to FIG. 5 and FIG. 6.

Figure 5:
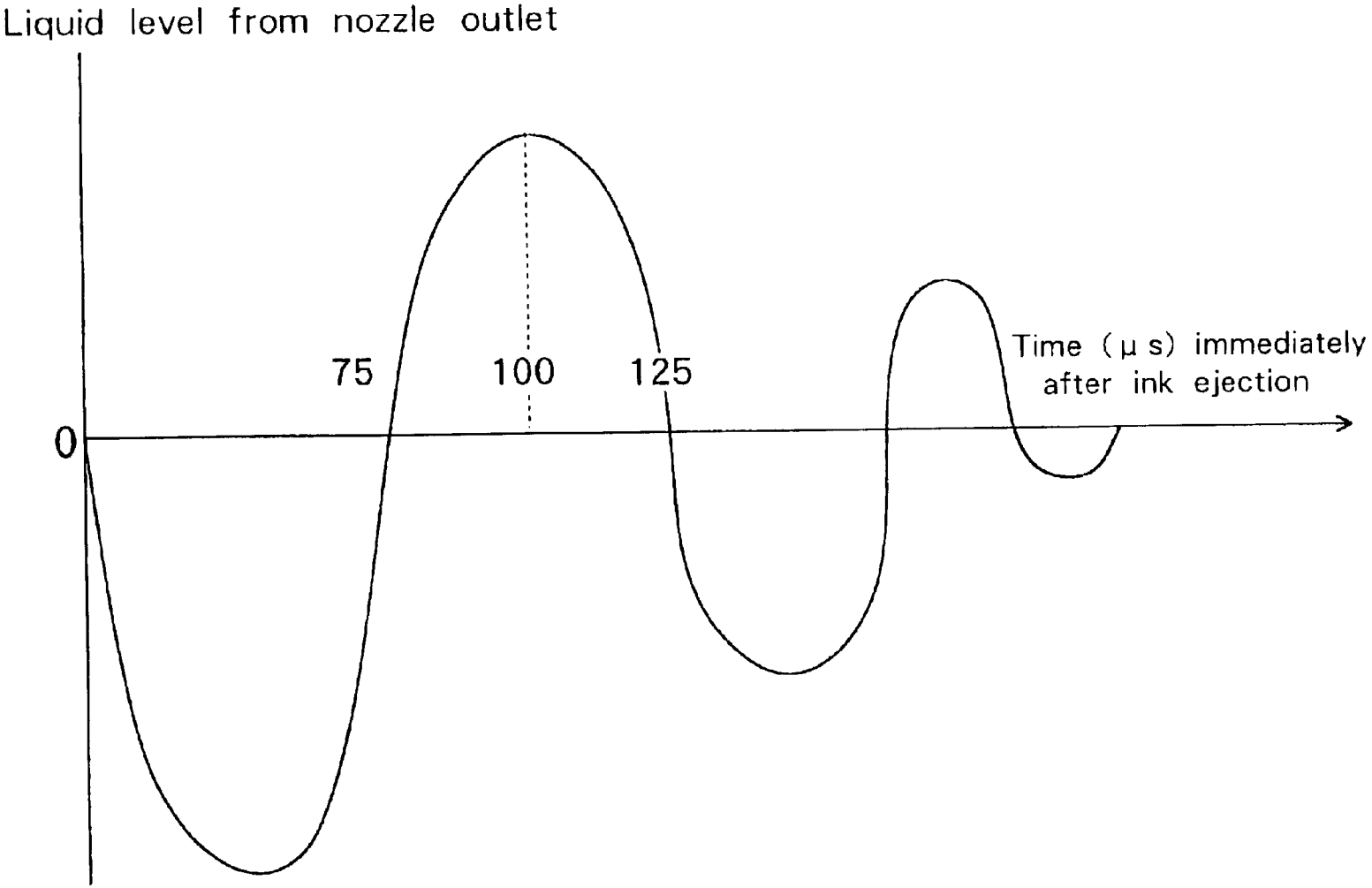
FIG. 5 is a graph showing change of the ink liquid face at an outlet of the nozzle immediately after ink ejection.

FIG. 5 is a graph showing change of the ink liquid face at an outlet of the nozzle immediately after ink ejection at an environment temperature of 23° C., the ordinate representing the height a liquid face bulging out from the nozzle outlet, and the abscissa representing the period (time). FIG. 6 is a graph showing the ink ejection quantity corresponding to the change of the ink liquid face shown in FIG. 5, the ordinate representing the quantity of the ink ejected from the nozzle, and the abscissa representing the cycle period (time). In FIGS. 5 and 6, the data were obtained by experiment.

In recovery ejection of a printing head having the structure as shown in FIG. 4 by simultaneous heat generation of an image-forming heater element 52 and an ejection-recovering heater element 54, the ink liquid face 41*a* of the ink 41 causes damped vibration at the outlet 40*a* of the nozzle 40 (FIG. 4) immediately after the ink ejection as shown in FIG. 5. During the damped vibration, the liquid face 41*a* rises (bulges out) most remarkably at a timing of 100 μs immediately after the ejection of the ink 41 form the outlet 40*a* of the nozzle 40.

Figure 6:
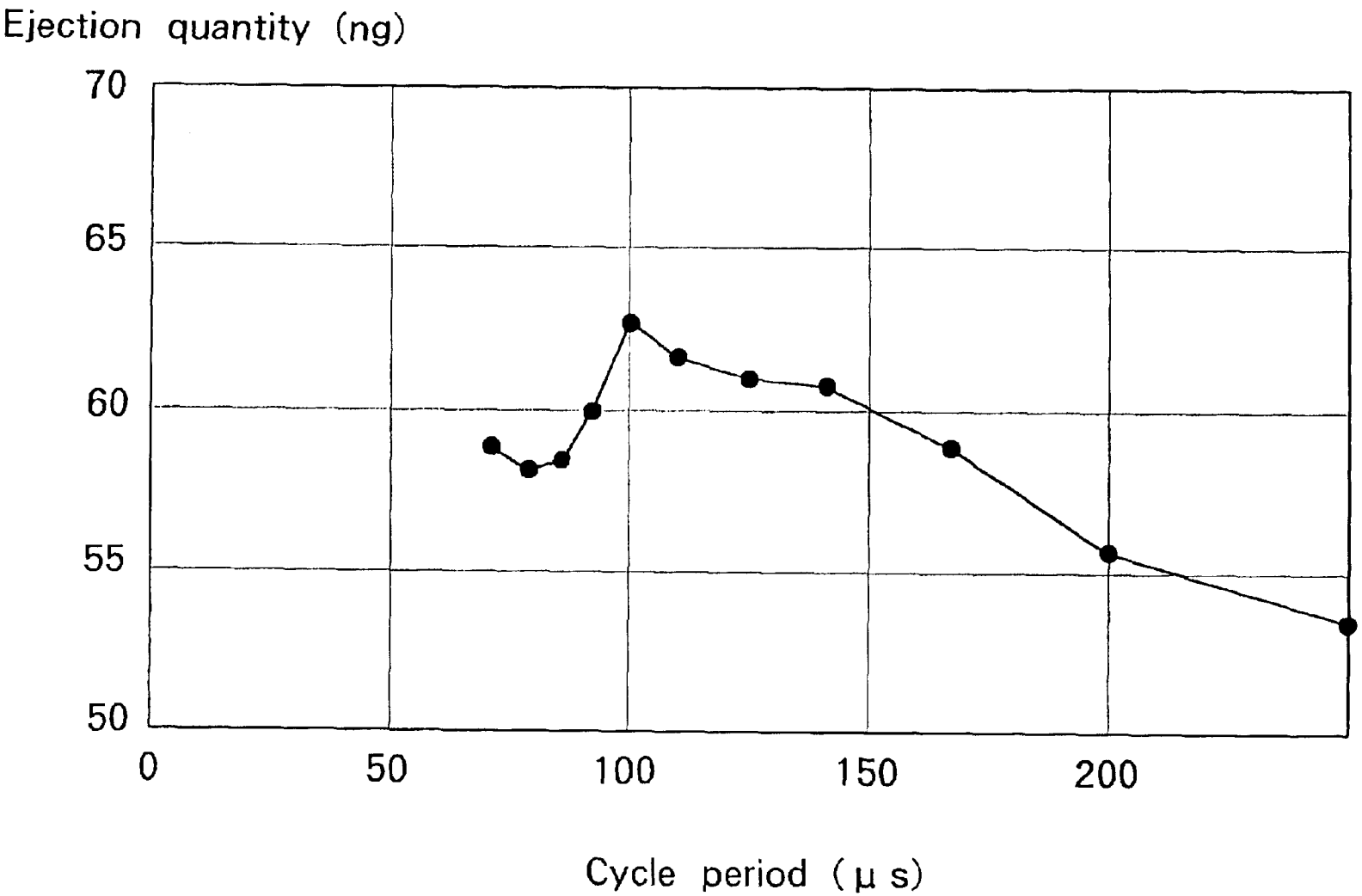
FIG. 6 is a graph showing dependence of the ink ejection quantity on the ink ejection cycle period.

The ejection quantity of the ink 41 is maximum when the subsequent ejection is conducted at the time of maximum bulging of the liquid face 41*a* of the ink 40 (ink being ejected at a cycle period of 100 μs) according to FIG. 6, the graph showing the dependency of ink ejection quantity on the ink ejection cycle period.

In other words, by adjusting the ink ejection cycle period to 100 μs (recovery ejection at ink ejection frequency of 10 KHz), the ink 41 can be ejected in a most bulging state of the liquid face 41*a* to increase the ink discharge in the recovery ejection. Thereby, the bubble or the like remaining in the inside of the printing head can be removed more surely.

The above explanation assumes the construction of the printing head as shown in FIG. 4. The same effect can be achieved by ejecting the ink at an ejection cycle corresponding to of the time of the maximum bulging of the liquid face regardless of the state of the liquid face vibration immediately after the ink ejection resulting from the construction of the printing head and the ink employed.

Another example of the timing of the simultaneous heat generation of image-forming heater elements 52 and the ejection-recovering heater element 54 is explained below.

In the aforementioned example, one image-forming heater element 52 and one ejection-recovering heater element 54 are provided for each one nozzle 40. In this example, three or more heater elements are provided in the vicinity of one nozzle 40.

With three or more heater elements near the one nozzle 40, in image formation on a recording medium, the head controller 11 (FIG. 1) controls the respective heater elements to generate heat in one or more heater elements simultaneously to eject the ink. For removal of a bubble, a foreign matter, or a dried ink residue from the nozzle 40, the head controller 11 (FIG. 1) controls the respective heater elements to generate heat in two or more heater elements simultaneously to eject ink in a maximum ink ejection quantity. Thereby, the bubble or the like is removed more surely from the nozzles 40.

In the case where three or more heater elements are provided near one nozzle 40, the bubble and the dried ink residue can be removed surely from each of the nozzle 40 without driving all the heater elements simultaneously. In such a case, for removal of the bubble or the like, the quantity of the ejected ink and the timing of the heat generation can be changed by changing the arrangement position of the heating elements and combination of simultaneously driven heating elements. Therefore, suitable combination of three or more heating elements enables surer removal of the bubble or the like from the nozzle 40.

Further, the quantity of the ink ejection from the nozzle 40 depends on the arrangement positions of the heater elements and the combination of the simultaneously driven heater elements. Therefore, in formation of an image on a recording medium, the quantity of the ink ejected from the nozzle 40 can be changed and the size of the ink droplet depositing on the recording medium can be changed by changing the combination of the simultaneously driven heater elements.

In the printing head 22 having the above-mentioned construction, a bubble is liable to be formed at a portion 40*b* near the outlet 40*a* inside the nozzle 40 as shown in FIG. 4. This bubble, when it grows larger, retards the ink ejection from the nozzle 40. To discharge the bubble from the nozzle, a larger amount of the ink is intermittently ejected from the nozzle 40 in the recovery ejection. This recovery ejection is explained below.

In the recovery ejection, the ink is ejected plural times intermittently at prescribed intervals from the nozzle 40. The shorter the time interval, the larger is the repetition times of the ink ejection per unit time (e.g., one second). The number of times of the intermittent ink ejection per unit time is called a printing head driving frequency. Herein, the plural times of intermittent ink ejection in a unit time is called a unit recovery ejection which is caused by intermittent driving of both of the image-forming heater elements 52 (FIG. 4) and the ejection-recovering heater elements 54 (FIG. 4) to generate heat intermittently at prescribed intervals. This unit recovery ejection is an example of the recovery ejection.

In the unit recovery ejection, the ink is ejected plural times in a unit time as described above. Therefore, in unit recovery ejection, the ejection conditions (printing head driving frequency, ink ejection times, etc.) are selected to discharge the bubble and the foreign matter completely by one unit recovery ejection to avoid waste of the ink.

For this purpose, the ink is ejected when the liquid face of the ink 41 is bulging out as explained by reference to FIGS. 5 and 6 (for example, ink is ejected at the time intervals of 100 μs). Thereby, the ink ejection quantity is the largest as shown in FIG. 6. That is, at an environmental temperature of 23° C., the ink ejection quantity for a unit recovery ejection can be increased by ejecting the ink invariably in a state of largest bulging at the ink ejection cycle period of 100 μs (printing head driving frequency F: 10 KHz). If the number of times of the ink ejection for one unit recovery ejection is excessive, the ink may be ejected even after the bubble or the foreign matter is discharged to waste the excess of the ink.

Therefore, in one unit recovery ejection, the number of times of the ink ejection and the driving frequency of the printing head are selected to discharge surely the bubble or the foreign remaining in the printing head and to decrease waste of the ink.

For efficient discharge of the bubble, the driving frequency of the printing head and the number of times of the ink ejection are determined preliminarily which correspond to the damped vibration frequency varying with the environmental temperature (inside temperature of the printing head). Practically, the driving frequency of the printing head and the number of times of the ink ejection are decided according to the measured inside temperature of the printing head. This decision is made, for example, by the head controller 11 (FIG. 1). The head controller 11 controls both of the image-forming heater elements 52 (FIG. 4) and the recovery ejection heater elements 54 (FIG. 4) according to the decided printing head driving frequency and the decided ejection times. Incidentally, to decide the driving frequency of the printing head is to determine the time intervals of plural intermittent ink ejections from the nozzle 40.

Table 1 shows the printing head driving frequency and the ink ejection times corresponding to the inside temperature of the printing head.

TABLE 1

| Head temperature I | Printing head driving-frequency F | Number of times of ink ejection M |
|---|---|---|
| 15° C. | 12.00 kHz | 62 times |
| 17° C. | 11.50 kHz | 54 times |
| 19° C. | 11.25 kHz | 50 times |
| 21° C. | 10.75 kHz | 42 times |
| 23° C. | 10.00 kHz | 30 times |
| 25° C. | 9.50 kHz | 25 times |
| 27° C. | 9.00 kHz | 21 times |
| 29° C. | 8.50 kHz | 17 times |
| 31° C. | 8.25 kHz | 15 times |
| 33° C. | 7.75 kHz | 14 times |
| 35° C. | 7.00 kHz | 13 times |
| 37° C. | 6.50 kHz | 12 times |
| 39° C. | 6.25 kHz | 11 times |
| 40° C. | 5.75 kHz | 10 times |

From Table 1, for example, at the inside temperature I of 23° C. of the printing head, the printing head driving frequency F is adjusted to 10.00 kHz (cycles of 100 $\mu$s in terms of the time interval), and the ink ejection times M is set at 30. The driving frequency F of the printing head and the number of times M of the ink ejection are less at the higher inside temperature of the printing head.

Figure 7:
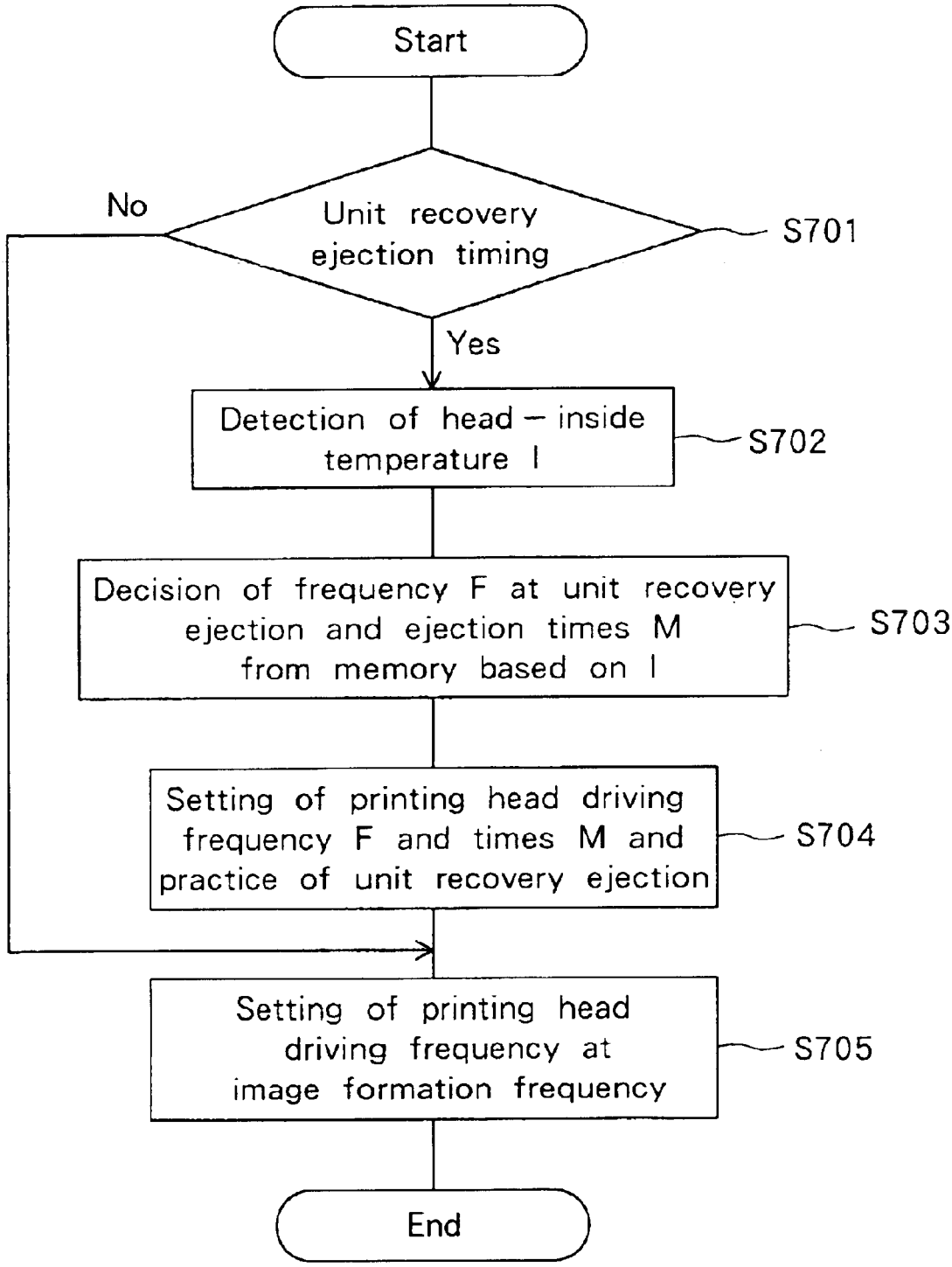
FIG. 7 is a flow chart showing a procedure of controlling a heater element line for ink ejection by a head controller in ejection recovery by a head controller.

The data in Table 1 is stored in the memory 13 of the plotter 10 (FIG. 1). The aforementioned head controller 11 (FIG. 1) built in the plotter 10 has a function of controlling the signals for driving the ink-ejecting heater element line 50. FIG. 7 shows a flow of controlling the ink ejecting heater element line 50 with the controller 11.

FIG. 7 is a flowchart showing the procedure for controlling the ink-ejecting heater element line by the head controller 11 of the plotter 10.

This flow is started with beginning of image formation operation of the plotter 10. Firstly, the judgment is made whether it is at a timing for conducting the unit recovery ejection (S701). When the process is judged to be at the timing of the unit recovery ejection, the inside temperature I of the printing head is detected (measured) by a DI sensor 56 (FIG. 3) for detecting the head inside temperature I of the head (S702). According to the measured inside temperature I, the memory 13 decides the printing head driving frequency F and the ink ejection times M (S703). The decided printing head driving frequency F and the ink ejection times M are set, and based on this setting, the head controller 11 controls the image-forming heater elements 52 (FIG. 4) and the ejection-recovering heater elements 54 (FIG. 4) to conduct the unit recovery ejection (S704). Thereby, any bubble or any foreign matter in the printing head is discharged efficiently and surely. A dried ink residue is also removed. As the results, waste of the ink without image formation is reduced, and moreover, failure of the ink ejection in image formation is prevented.

On completion of the above unit recovery ejection, the printing head-driving frequency is set at the frequency for image formation (S705). When the process is judged at S701 not to be at the timing of the unit recovery ejection, the printing head-driving frequency is set at the frequency for image formation (S705).

The above explanation is made by assuming the printing head having the construction shown in FIG. 4. In the case where the liquid face vibrates in a different manner owing to the construction of the printing head or the ink employed, the same effects can be obtained by ejecting the ink at an ink ejection cycle time corresponding to the maximum bulging time.

There are various types of inks: dye type inks, pigment type inks, and so forth. Plural printing heads mounted on one carriage 20 (FIG. 1) may employ different types of inks from each other The data shown in Table 1 depend on the type of the ink. Therefore, the data of the printing head driving frequency and the ink ejection times for the type of the ink are stored preliminarily in the memory 13. Thereby, the printing head driving frequency and the ink ejection time are decided according to the measured inside temperature of the printing head. Table 2 and Table 3 shows examples. Table 2 shows an example for a dye type ink, and Table 3 show an example for a pigment type ink.

TABLE 2

| Head temperature I | Printing head driving-frequency FS | Number of times of ink ejection MS |
|---|---|---|
| 15° C. | 12.00 kHz | 62 times |
| 17° C. | 11.50 kHz | 54 times |
| 19° C. | 11.25 kHz | 50 times |
| 21° C. | 10.75 kHz | 42 times |
| 23° C. | 10.00 kHz | 30 times |
| 25° C. | 9.50 kHz | 25 times |
| 27° C. | 9.00 kHz | 21 times |
| 29° C. | 8.50 kHz | 17 times |
| 31° C. | 8.25 kHz | 15 times |
| 33° C. | 7.75 kHz | 14 times |
| 35° C. | 7.00 kHz | 13 times |
| 37° C. | 6.50 kHz | 12 times |
| 39° C. | 6.25 kHz | 11 times |
| 40° C. | 5.75 kHz | 10 times |

TABLE 3

| Head temperature I | Printing head driving-frequency FG | Number of times of ink ejection MG |
|---|---|---|
| 15° C. | 10.00 kHz | 50 times |
| 17° C. | 9.60 kHz | 47 times |
| 19° C. | 9.20 kHz | 44 times |
| 21° C. | 8.80 kHz | 41 times |
| 23° C. | 8.40 kHz | 38 times |
| 25° C. | 8.00 kHz | 35 times |
| 27° C. | 7.60 kHz | 32 times |
| 29° C. | 7.20 kHz | 29 times |
| 31° C. | 6.80 kHz | 26 times |
| 33° C. | 6.40 kHz | 23 times |
| 35° C. | 6.00 kHz | 20 times |
| 37° C. | 5.60 kHz | 17 times |
| 39° C. | 5.20 kHz | 14 times |
| 40° C. | 4.80 kHz | 11 times |

The plotter 10 (FIG. 1) may be equipped with a detector for detecting the type of the ink. The printing head driving frequency and the ink ejection times may be decided according to the type of the ink detected by the detector. The procedure therefor is explained by reference to FIG. 8.

Figure 8:
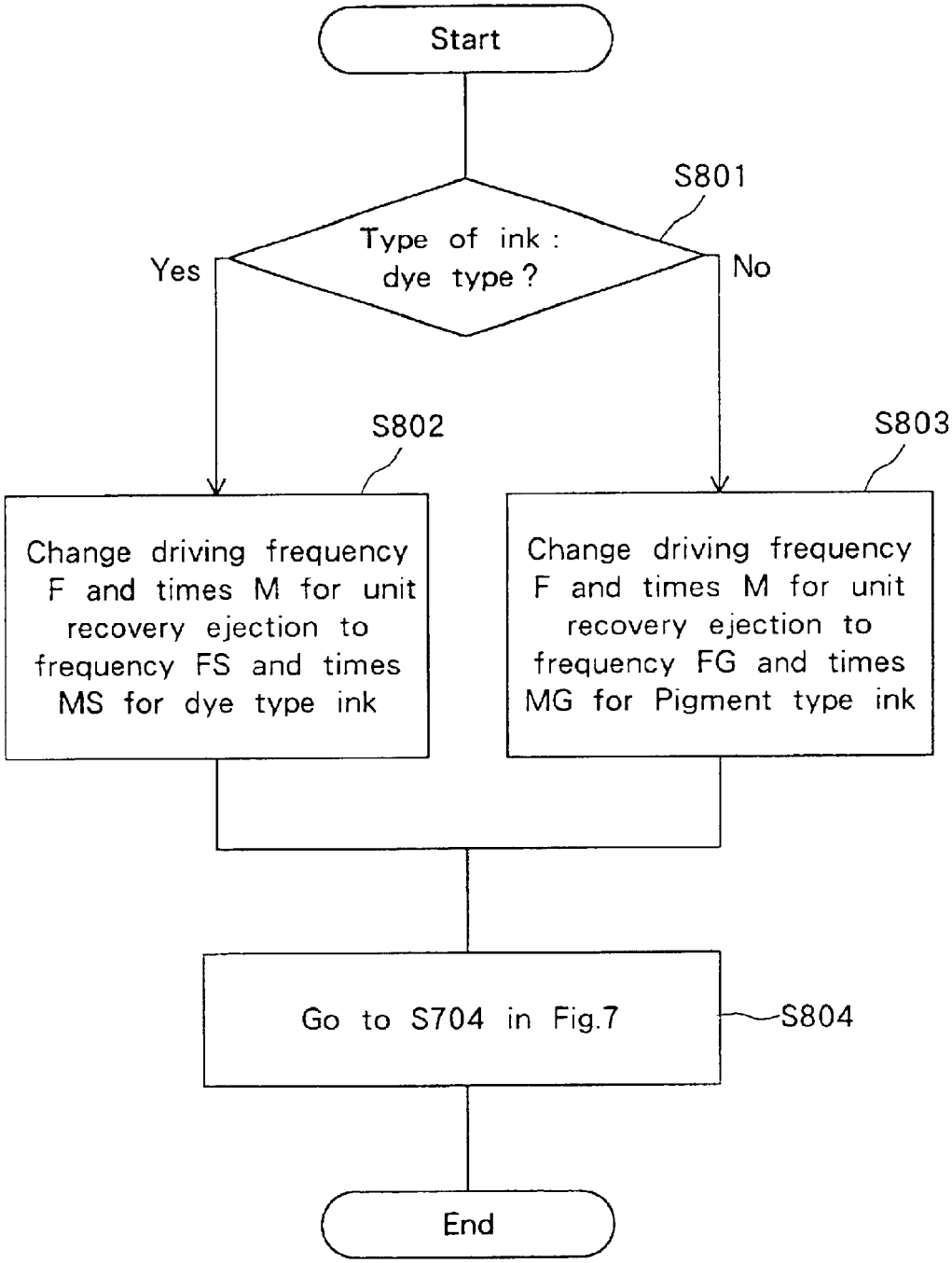
FIG. 8 is a flow chart showing a procedure of controlling a line of heater elements for ink ejection by a head controller depending on the kind of ink.

FIG. 8 is a flowchart showing the procedure for control of the ink ejection heater element line by the head controller 11.

This flow is started when the plotter 10 begins an image formation operation. Firstly, the type of the ink in the printing head is detected (S801). When the ink in the printing head is detected to be a dye type ink, the printing head driving frequency for the unit recovery ejection is changed to the frequency FS for the dye type ink as shown in Table 2, and simultaneously the ink ejection times is changed to the ejection times MS for the dye type ink as shown in Table 2. Thereafter the step S704 is selected (S804) and is practiced. When the ink of the printing head is detected to be a pigment type ink, the printing head driving frequency for the unit recovery ejection is changed to the frequency FG for the pigment type ink as shown in Table 3, and simultaneously the ink ejection times is changed to the ejection times MG for the pigment type ink as shown in Table 3. Then the step S704 is selected (S804) and is practiced.

By selecting the printing head driving frequency and the ink ejection times for the kind of the ink as mentioned above, the bubble or the foreign matter can be discharged more efficiently and more surely, enabling decrease of the waste of the ink without image formation and prevention of defective ink ejection in image formation.

In the above example, the image-forming heater elements 52 and the recovery ejection heater elements 54 (both in FIG. 4) are driven for heat generation in the recovery ejection. However, the recovery ejection can be conducted without the simultaneous heat generation of the both kinds of heater elements. A plotter conducting such recovery ejection is explained below. This plotter has nearly the same construction as that of the aforementioned plotter 10 (FIG. 1) except the construction of the head controller 11. This is explained below by reference to FIG. 9. The performance in ink ejection (the quantity of the ink in one ejection, called ink ejection performance) of the recovery ejection heater elements 54 is higher the that of the image-forming heater elements 52.

Figure 9:
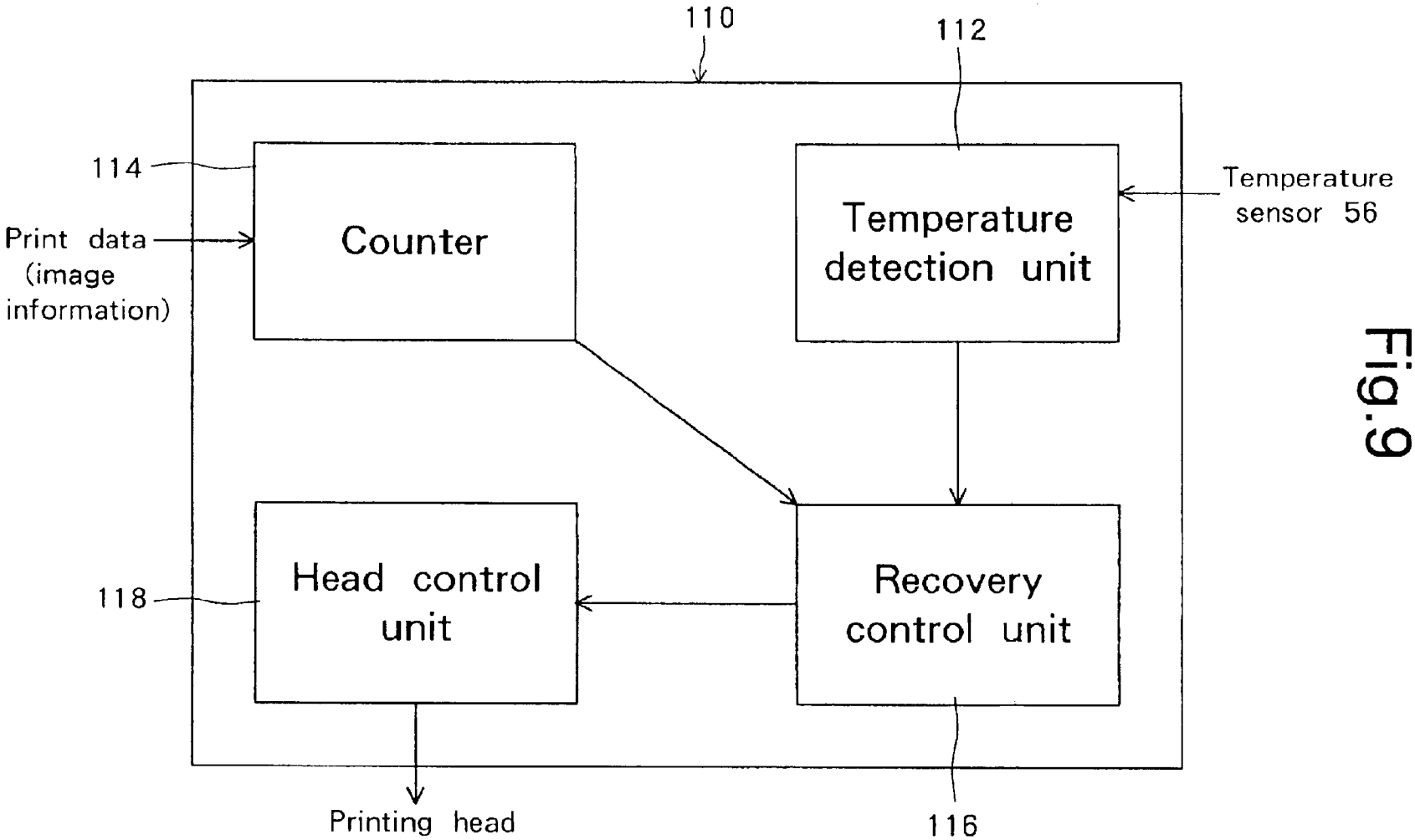
FIG. 9 is a schematic drawing showing a controller for controlling image-forming heater elements and preliminary ink-ejection heater elements.

FIG. 9 is a schematic drawing showing a controller for controlling image-forming heater elements 52 and preliminary ink-ejection heater elements 54.

The controller 110 is incorporated in a plotter having a structure similar to the plotter 10 (FIG. 1). The controller 110 has a temperature detection unit 112 built therein for receiving signals transmitting the head temperature (environmental temperature) from the temperature sensor 56 (FIG. 3). The controller has a counter 114 for counting the times of driving of the image-forming heater elements 52 (driving times) according to the image data (print data). The controller 110 has also a recovery control unit 116 built therein for controlling the timing of driving the image-forming heater elements 52 and the recovery ejection heater elements 54 for heat generation based on the number counted by the counter 114. Further, the controller 110 has a head controller 118 built therein for turning on or off (control) the image-forming heater elements 52 and the recovery ejection heater elements 54 according to the driving signals from the recovery control unit 116.

When the count of the counter 114 has reached to a prescribed number, the recovery control unit 116 transmits driving signal to the head controlling unit 118 to drive the image-forming heater elements 52 and the recovery ejection heater elements 54 to generate heat. In the driving of the heaters, the recovery ejection heater elements 54 is driven to generate heat at the timing (the second timing in the present invention) later than the timing (the first timing in the present invention) of heat generation of the image-forming heater elements 52. In this case, the image-forming heater elements 52 only generate heat to eject the ink retained in the downstream side of the ink ejection direction (nozzle tip portion). Next, the recovery ejection heater elements 54 generate heat in the absence of the ink at the nozzle tip portion. Thereby, the ink existing near the recovery ejection heater elements 54 (upstream portion before the nozzle tip against the ink ejection direction) is ejected. The ejection of the ink at the upstream portion is promoted by the absence of the ink at the nozzle tip portion. Therefore, the bubble or the foreign contained in the ink can be more surely removed.

The aforementioned prescribed number of the count changed depending on the head temperature. The prescribed number is stored in the recovery control unit 116. Table 4 shows an example for this.

TABLE 4

| Head temperature (° C.) | Count trigger (×1000) |
|---|---|
| 0 | 12.0 |
| 1 | 12.5 |
| 2 | 13.5 |
| — | — |
| — | — |
| 35 | 200 |
| 40 | 200 |

Table 4 shows that the prescribed number of times (count trigger in Table 4) increases with the rise of the temperature of the head. That is, the higher the head temperature, the less is the number of times of conducting the recovery ejection.

To the recovery control unit 116, signals carrying the head temperature is inputted from the temperature detection unit 112, and the number counted by the counter 114 are also inputted. The driving signals for driving the image-forming heater elements 52 and the recovery ejection heater elements 54 are transmitted from the recovery control unit 116 having a memory of the content of Table 4 to the head control unit 118. According to this transmitted driving signals, the head control unit 118 drives the image-forming heater elements 52 and, then the recovery ejection heater elements 54 with a time lag. Thereby, the ejection recovery is conducted to remove the bubble or the foreign matter from the nozzle 40 (FIG. 4). By such operation, the nozzle 40 can be cleaned in a shorter time than the cleaning by means of the recovery device 30 (FIG. 1). In the above example, the prescribed times for the trigger for the recovery ejection is varied depending on the head temperature. However, this prescribed number of times may be fixed. In this case, the temperature detection unit 112 may be omitted with without impairing the effects. In the above examples, heat-generating element was used as the ink-ejecting element, but a piezo element which causes piezo-electric phenomenon is also useful therefor.

INDUSTRIAL APPLICABILITY

In the first embodiment of the ink-jet imaging apparatus of the present invention, the first ink-ejection element and the second ink-ejection element are simultaneously driven, whereby a larger quantity of the ink is simultaneously ejected (recovery ejection). This enables the recovery operation in a shorter time to discharge the bubble or the foreign matter together with the ink from the nozzle and to restore the normal state of the nozzle. The ink ejection can be conducted in a shorter time by use of an ink ejection element like the heat-generating element or the piezo element. In contrast, the forcible suction with a suction pump of the recovery device will takes a long time. Accordingly, the present invention can recover the normal state of the inside of the nozzle in a short time. In normal printing, the recording paper sheet is delivered by one printing band breadth, and immediately thereafter the printing head is allowed to scan to conduct printing in a constant printing time. Therefore, the front end of the printing area by scanning of the printing head comes to overlap (at the print band joint) at a constant time interval with the rear end of the printed area formed by one scanning (preceding scanning) of the printing head. In the case where the recovery operation is conducted with the recovery device during printing, the next scanning of the printing head is delayed, changing the time of overlapping of the ink at the printing band joint portion. That is, the recovery operation by the recovery device lengthen the drying time of the ink deposited in the preceding scanning, causing a color tone different from the normal at the printing band joint portion, and color irregularity. However, according to the present invention, the nozzle is recovered by the recovery ejection to the normal state in a shorter time without causing color irregularity.

In the second embodiment of the inkjet imaging apparatus of the present invention, two or more ink-ejection elements are simultaneously driven, whereby a larger quantity of the ink is simultaneously ejected. This enables the recovery operation in a shorter time to discharge a bubble, a foreign matter, or a dried ink residue together with the ink from the nozzle and to restore the normal state of the nozzle. The ink ejection can be conducted in a shorter time by use of an ink ejection element. In contrast, the forcible suction with a suction pump of the recovery device will takes a long time. Accordingly, the present invention can recover the normal state of the inside of the nozzle in a shorter time.

The timing of driving the aforementioned ink ejection element may be controlled so as to correspond with the shape of the ink face at the nozzle outlet. By this control, the quantity of the ejected ink is increased by driving the ink ejection element at the timing of maximum outside bulging of the ink face at the nozzle outlet, whereby the ink residue or the bubble is more surely ejected from the nozzle. Consequently, the bubble or the like is removed from the nozzle to restore the normal state of the nozzle.

The ink-jet imaging apparatus may have a temperature sensor for measuring the inside temperature of the printing head. With such a temperature sensor, the time intervals of the ink ejection (or the printing head driving frequency) is decided by a controller based on the inside temperature of the printing head to maximize the quantity of the ejected ink, since the timing of the maximum ink ejection in one ejection from the printing head nozzle depends on the inside temperature of the printing head. Thereby, a larger amount of the ink can be ejected to discharge the bubble or the foreign matter from the nozzle efficiently and surely. Consequently, waste of the ink without image formation is decreased, and failure of the ink ejection in image formation is prevented.

The above inkjet imaging apparatus may have two or more of the printing heads, and the controller may decide the prescribed time intervals for each printing head according to the properties of the ink ejected from the respective printing head. The timing for the maximum ink amount of one ejection through the nozzle may vary even if the inside temperature of the printing head is the same depending on the ink properties (for example, a dye type ink, or a pigment type ink). In such a case, the above time interval can be decided depending on the ink properties to eject a larger amount of the ink at one time to discharge the bubble or the foreign matter more efficiently and more surely. Consequently, waste of the ink not used for image formation is decreased, and failure of the ink ejection in image formation is prevented.

The above ink-jet imaging apparatus may have a memory for storing preliminarily the aforementioned time interval variable depending on the printing head inside-temperature, and the aforementioned controller may control both of the first ejection elements and the second ejection element to eject the ink at the time interval according to the stored memory for the inside temperature detected by the temperature sensor. With such a memory, the ink is ejected from the nozzle by control of the both of the first and second ink-ejecting elements by the controller according to the memory. Thereby the bubbles or the foreign matter is discharged more efficiently and more surely.

The aforementioned controller may decide the times of simultaneous driving of the first and the second ink ejection elements according to the temperature measured by the temperature sensor. In this case, the number of times of the ink ejection is decides to be minimum to prevent unnecessary ink ejection.

The aforementioned ink-jet imaging apparatus may have two or more of the aforementioned printing heads, and the controller may decide the aforementioned number of times for each of the printing heads according to the properties of the ink. In this case, since the number of times of the ink ejection is decided for each of the printing heads, unnecessary ink ejection is prevented.

The aforementioned memory may store the number of times of the simultaneous driving of the first and second ink-ejection elements as a function of the printing head-inside temperature, and the controller may control both of the first and second ink ejecting elements to eject the ink according to the inside temperature measured by the temperature sensor at the number of ejection times and the ejection time intervals derived from the data stored in the memory. In this case, since the ink is ejected through the nozzle by control of the printing head by the controller according to the memory, the bubble or the foreign matter is discharged more surely and more efficiently from the printing head.

In the third embodiment of the ink-jet imaging apparatus of the present invention, a larger quantity of the ink is ejected by driving the second ink ejection element than single drive of the first ejection element, whereby the bubble or the foreign matter is removed by the larger amount of the ejected ink to clean the nozzle. The second ejection element is placed upstream in the ink ejection direction before the first ink ejection element. Thereby, the bubble or the like formed by the first ejection element is removed surely.

This third inkjet imaging apparatus of the present invention may have a controller for controlling the first and second ink ejection elements so as to drive the first ejection element at a first timing and to drive the second ejection element at a second timing later than the first timing. In this case, the first ejection element driven at the first timing ejects the ink existing in the downstream side (at the nozzle tip portion). Then the second ink ejection element is driven at the second timing in the absence of the ink at the nozzle tip portion. By this driving, the ink existing in the vicinity to the second ink ejection element is ejected (the ink at the upstream side before the nozzle tip portion). In this ejection, the ink existing upstream before the nozzle tip portion is readily ejected, which enables surer removal of the bubble or the foreign matter contained in the ink.

The third inkjet imaging apparatus of the present invention may be provided with a counter for counting the number of times of the driving of the first ink ejection element, and the aforementioned controller may drive the second ink ejection element when the counted number reaches a prescribed number. In this case, by setting suitably the prescribed number, the bubble or the foreign matter is readily removed to prevent deterioration of image quality.

The third ink-jet imaging apparatus of the present invention may have a temperature sensor for measuring the inside temperature of the printing head, and the aforementioned controller may drive the second ink ejection element at the prescribed number of times selected in corresponding with the inside temperature of the printing head detected by the temperature sensor. In this case, even when the possible time of bubble occurrence is shifted by the change of the printing head-inside temperature, the second ink ejection element is driven in accordance with the shifted time to eject the ink to remove the bubble surely.

The ink-ejection element can be made simpler and smaller by employing any of heat generating elements and piezo elements utilizing a piezoelectric effect.

What is claimed is:

1. An ink-jet imaging apparatus having a printing head having plural nozzles for ink ejection, and first ink ejection elements formed respectively near each of the nozzles for ejecting the ink from the nozzle; and forming an image by driving the first ink ejection element to eject the ink, wherein the inkjet imaging apparatus comprises:

second ink ejection elements formed respectively upstream against the ink ejection direction before the first ink ejection element for ejecting the ink from the nozzles, and a controller which drives, on prescribed ejection recovery, the first ink ejection elements and the second ink ejection elements simultaneously to eject the ink through the nozzles for ink ejection recovery, wherein the controller functions to change timing of ink ejection of the ink ejection element in correspondence with the shape of the ink liquid face at the outlet of the nozzle, wherein the ink ejection element is operated at a time of a maximum outwardly extension of the ink liquid face for providing a greater volume of ink ejection for recovery purposes.

2. An ink-jet imaging apparatus having a printing head having plural nozzles for ink ejection, and first ink ejection elements formed respectively near each of the nozzles for ejecting the ink from the nozzle; and forming an image by driving the first ink ejection element to eject the ink, wherein the ink-jet imaging apparatus comprises:

second ink ejection elements formed respectively upstream against the ink ejection direction before the first ink ejection element for ejecting the ink from the nozzles, and a controller which drives, on prescribed ejection recovery, the first ink ejection elements and the second ink ejection elements simultaneously to eject the ink through the nozzles for ink ejection recovery, wherein the controller is provided with a temperature sensor for detecting the inside temperature of the printing head, and a controller which drives, on prescribed ejection recovery, both of the first ink ejection element and the second ink ejection element simultaneously at prescribed time intervals intermittently in correspondence with the temperature detected by the temperature sensor to eject the ink through the nozzles.

3. The ink-jet imaging apparatus according to claim 2, wherein two or more of the printing heads are provided, and the controller decides the time interval for each of the printing heads in correspondence with properties of the ink to be ejected from the nozzle of each of the printing heads.

4. The ink-jet imaging apparatus according to claim 3, wherein a memory is provided for memorizing preliminarily the prescribed time interval varying in dependence of the inside temperature of the printing head for each of the inside temperature, and the controller may control both of the first ink ejection element and the second ink ejection element to eject the ink at intervals memorized in the memory based on the inside temperature detected by the temperature sensor.

5. The ink-jet imaging apparatus according to claim 4, wherein the memory memorizes the number of times of simultaneous driving of the first ink ejection element and the second ink ejection element, varying with the inside temperature of the printing head, and controller controls bath of the first ink ejection element and the second ink election element to eject the ink in the number of times and in the time intervals derived from the memory depending on the inside temperature detected by the temperature sensor.

6. The ink-jet imaging apparatus according to claim 3, wherein the controller decides the number of times of simultaneous driving of the first ink ejection element end the second ink ejection element based on the temperature detected by the temperature sensor.

7. The ink-jet imaging apparatus according to claim 6, wherein two or more of the printing heads are provided, and the controller decides the above-mentioned number of times for each of the printing heads independently in accordance with properties of the ink to be ejected through the nozzle of each of the printing heads.

8. The ink-jet imaging apparatus according to claim 2, wherein a memory is provided for memorizing preliminarily the prescribed time interval varying in dependence of the inside temperature of the printing head for each of the inside temperature, and the controller may control both of the first ink ejection element and the second ink ejection element to eject the ink at interval memorized in the memory based on the inside temperature detected by the temperature sensor.

9. The ink-jet imaging apparatus according to claim 6, wherein the memory memorizes the number of times of simultaneous driving of the first ink ejection element and the second ink ejection element, varying with the inside temperature of the printing head, and the controller controls both of the first ink ejection element and the second ink ejection element to eject the ink in the number of times and in the time intervals derived from the memory depending on the inside temperature detected by the temperature sensor.

10. The ink-jet imaging apparatus according to claim 8, wherein the controller decides the number of times of simultaneous driving of the first ink ejection element and the second ink ejection element based on the temperature detected by the temperature sensor.

11. The ink-jet imaging apparatus according to claim 10, wherein two or more of the printing heads are provided, and the controller decides the above-mentioned number of times for each of the printing heads independently in accordance with properties of the ink to be ejected through the nozzles of each of the printing heads.

12. The ink-jet imaging apparatus according to claim 2, wherein the controller decides the number of times of simultaneous driving of the first ink ejection element and the second ink ejection element based on the temperature detected by the temperature sensor.

13. The ink-jet imaging apparatus according to claim 12, wherein two or more of the printing heads are provided, and the controller decides the above-mentioned number of times for each of the printing heads independently in accordance with properties of the ink to be ejected through the nozzles of each of the printing heads.

14. An ink-jet imaging apparatus having a printing head having plural nozzles for ink ejection, and plural ink ejection elements formed respectively near each of the nozzles for ejecting the ink from the nozzle; and forming an image by driving any of the ink ejection elements to eject the ink in accordance with image information signals, wherein the ink-jet imaging apparatus comprises:

a controller which drives, on prescribed ejection recovery, two or more of the ink ejection elements simultaneously to eject the ink through the nozzle for ink ejection recovery, wherein the controller functions to change timing of ink ejection of the ink ejection element in correspondence with the shape of the ink liquid face at the outlet of the nozzle, wherein the ink ejection element in operated at a time of a maximum outwardly extension of the ink liquid face for providing a greater volume of ink ejection for recovery purposes.

15. The ink-jet imaging apparatus according to claim 14, wherein the above ink ejection element is a heater element which generates heat, or a piezo element which causes a piezo electric effect.

* * * * *